US006470728B2

(12) United States Patent
Sekiguchi

(10) Patent No.: US 6,470,728 B2
(45) Date of Patent: Oct. 29, 2002

(54) COLD FORGING METHOD AND APPARATUS

(75) Inventor: Yoshio Sekiguchi, Higashimatsuyama (JP)

(73) Assignee: Sekiguchi Sangyo Co., Ltd., Higashimatsuyama (JP)

( * ) Notice: Subject to any disclaimer, the term of this patent is extended or adjusted under 35 U.S.C. 154(b) by 0 days.

(21) Appl. No.: 09/754,127

(22) Filed: Jan. 5, 2001

(65) Prior Publication Data

US 2001/0018842 A1 Sep. 6, 2001

(30) Foreign Application Priority Data

Mar. 1, 2000 (JP) ..... 2000-055620
Sep. 22, 2000 (JP) ..... 2000-287938

(51) Int. Cl.[7] ..... B21K 1/30
(52) U.S. Cl. ..... 72/344; 72/355.2
(58) Field of Search ..... 72/343, 352, 353.2, 72/355.2, 344; 29/893.34

(56) References Cited

U.S. PATENT DOCUMENTS 1,640,964 A * 8/1927 Schlaupitz et al. ..... 72/353.2
3,899,912 A * 8/1975 Orain ..... 72/344

FOREIGN PATENT DOCUMENTS

| | | | | |
|---|---|---|---|---|
| JP | 57-134230 | * | 8/1982 | ..... 72/344 |
| JP | 2-160135 | | 6/1990 | |
| JP | 5-337586 | * | 12/1993 | ..... 72/344 |
| JP | 7-310807 | | 11/1995 | |
| JP | 10-296382 | | 11/1998 | |
| JP | 11-10274 | | 1/1999 | |
| JP | 11-254082 | | 9/1999 | |
| JP | 11-254083 | | 9/1999 | |
| JP | 11-314134 | | 11/1999 | |
| RU | 565767 | * | 7/1977 | ..... 72/355.2 |

* cited by examiner

*Primary Examiner*—Lowell A. Larson
(74) *Attorney, Agent, or Firm*—Oblon, Spivak, McClelland, Maier & Neustadt, P.C.

(57) ABSTRACT

A stock inserted into a die is sandwiched between a punch and a knock-out, a predetermined pressing force is applied to the knock-out, and a pressing force larger than the sum of the pressing force of the knock-out and a pressing force for forming is applied to the punch to effect a forming work, whereby the forming accuracy can be enhanced and a final product can be obtained by going through only a slight finishing work.

7 Claims, 7 Drawing Sheets

50
51
52
27
41
61

COLD FORGING METHOD AND APPARATUS

BACKGROUND OF THE INVENTION

1. Field of the Invention

The present invention relates to a cold forging method suitable for forming such gears as a pinion gear and a helical gear.

2. Description of the Prior Art

In such gears as a pinion gear and a helical gear, their tooth shapes are complicated, and in case of producing them by machining, the machining time is long and the cost of machining is high. For this reason, cold forging has heretofore been adopted. In the case of a helical pinion gear constituted by a cylindrical portion of a large diameter with a gear portion formed thereon, it is difficult to form a base part of the gear portion with a high accuracy, so for improving the accuracy of the base portion there heretofore has been given a consideration so as to form a built-up part at the base of the gear portion to improve the flow of a stock, as is disclosed in Japanese Published Unexamined Patent Application Nos. hei 7-308729 and hei 7-310807. Also in Japanese Published Unexamined Patent Application No. hei 11-10274 there is disclosed a technique wherein an expanded part is formed at a base of a gear portion to enhance the accuracy of the tooth surface.

Helical pinion gears are usually produced by cutting or forging. A cold forging method so far adopted commonly will now be described with reference to FIGS. 7 to 9. First, a forming section 4 comprising a cylindrical forming portion 2 and a tooth pattern portion 3 is formed in a die 1, then a cylindrical stock 5 is inserted into the cylindrical forming portion 2 in the forming section 4, a knock-out 6 is positioned at an end of the tooth pattern portion 3 in the forming section 4, and on the side opposite to the knock-out 6 an end of the stock 5 is pressed down with a punch 7. Consequently, as shown in FIG. 7, the stock 5 shifts within the forming section 4 and is formed as such a helical pinion gear 8 as shown in FIG. 8 in the forming section 4 within the die 1. In this case, a space 9 is left between the helical pinion gear 8 and the knock-out 6. In this state, by rotating and pushing up the knock-out 6 the helical gear 8 is taken out upward from the die 1.

The helical pinion gear 8 thus formed by cold forging is made up of a cylindrical portion 10 and a gear portion 11, but there. is the first problem that underfill is apt to occur at the connection between the cylindrical portion 10 and the gear portion 11, that is, at a base part 12 of the gear, portion 11. And it is the second problem that a tip end 13 of the gear portion 11 droops.

For solving the-first problem that underfill is apt to occur at the base part 12 of the gear portion 11, a consideration is given in the foregoing Japanese Published Unexamined Patent Applications hei 7-308729 and hei 7-310807 such that the base 12 of the gear portion 11 is formed with a built-up portion to improve the flow of a stock. Also in the foregoing Japanese Published Unexamined Patent Application hei 11-10274 a measure is taken such that an expanded portion is formed at the base 12 of the gear portion 11 to enhance the accuracy of the tooth surface. However, the presence of such a built-up portion or an expanded portion at the base 12 of the gear portion 11 diminishes a substantially effective tooth surface area.

For solving the second problem that the tip end 13 of the gear portion 11 droops, there has heretofore been adopted such a measure as cutting the tip end 13 by machining and not using it. Thus, the portion once formed cannot be utilized effectively. This means that a fruitless forming has been done.

SUMMARY OF THE INVENTION

The present invention has been accomplished in view of the above-mentioned circumstances and it is an object of the invention to provide a cold forging method capable of enhancing the forming accuracy of each component portion and capable of affording a product the use of which requires only a slight finishing work.

In the present invention, a stock inserted into a die is sandwiched between a punch and a knock-out and a predetermined pressing force is applied to the knock-out, while a pressing force larger than the sum of the pressing force of the knock-out and a pressing force for forming is applied to the punch, to effect forming. Thus, the stock is sandwiched between the punch and the knock-out and is subjected to forming while undergoing a large compressive force, so that the forming is carried out in accurate conformity with a pattern shape of the die, whereby there can be obtained a highly accurate product.

In the present invention, the punch and the knock-out are rotated while forming a helical pinion gear, so that the forming of even such a helical pinion gear as is complicated in shape can be done without any problem.

In the present invention, the stock inserted into the die is sandwiched between the punch and the knock-out under a predetermined pressing force, and in this sandwiched state of the stock an axial pressing force larger than the sum of a pressing force of the knock-out and a pressing force for forming is applied to the punch while allowing the punch to rotate. Thus, the stock moves axially while being sandwiched between the punch and the knock-out and while undergoing a large compressive force, and the punch rotates during the forming work. Consequently, forming is carried out in accurate conformity with a pattern shape of the die even if the helix angle of the gear portion is large, and it is possible to obtain a highly accurate product.

In the present invention, the knock-out is mounted so as to rotate about the axis thereof. Therefore, a rotational force created by the punch in the forming work becomes free of resistance even on the knock-out side, whereby the forming of even such a helical pinion gear as is complicated in shape can be done without any problem.

The cold forging apparatus of the present invention comprises a die having a forming section to be formed, a knock-out which is fitted in the die rotatably and which is adapted to move axially, a punch which is fitted in the die rotatably and which is adapted to move axially, and a rotational force imparting means for imparting a rotational force to the punch.

In the present invention, a punch sleeve is fitted in a punch case rotatably, a punch is fitted in the punch sleeve in a rotational direction fixed manner, and a rack is brought into mesh with a gear formed on the punch sleeve to constitute the rotational force imparting means.

In the present invention, a special shape portion adapted to bite in a stock is formed at a tip end of the punch.

In the present invention, the knock-out is held by a thrust bearing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DETAILED DESCRIPTION OF THE PREFERRED EMBODIMENTS

Figure 1:
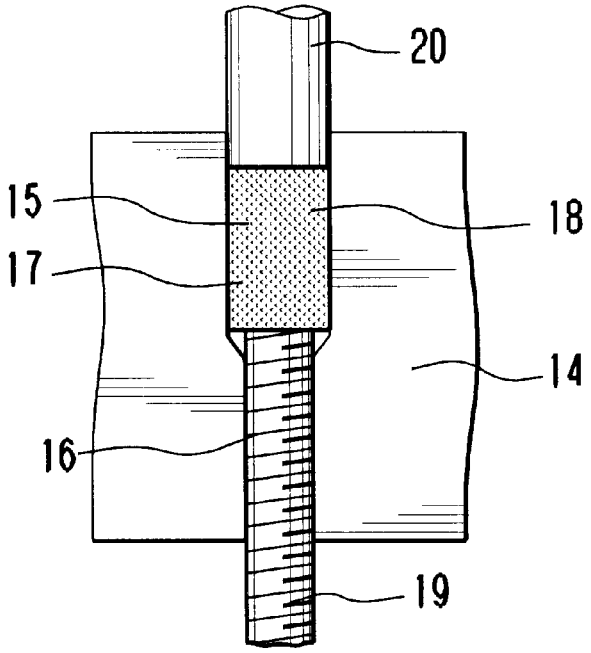
FIG. 1 is a side view in vertical section, showing a state before a forming work in a first embodiment of the present invention.
Figure 2:
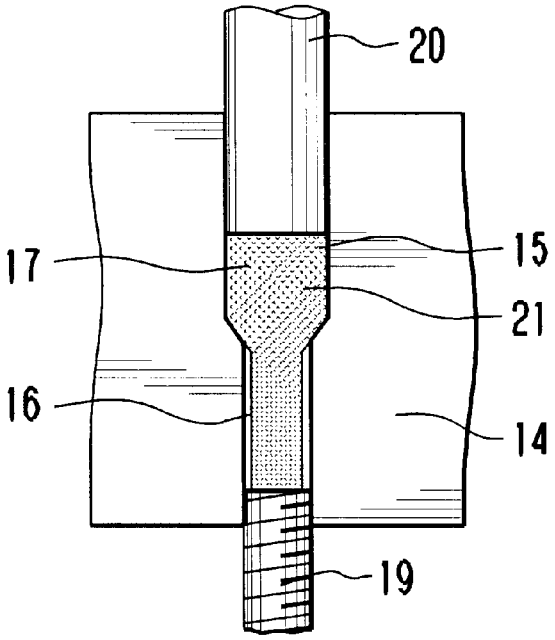
FIG. 2 is a side view in vertical section, showing a state after the forming work.
Figure 3:
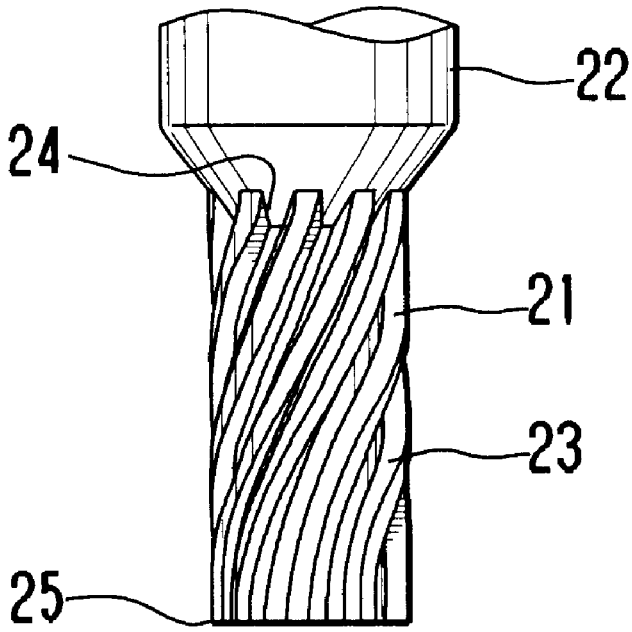
FIG. 3 is a front view of a helical pinion gear obtained by the forming work.

Referring to FIGS. 1 to 3, there is illustrated a first embodiment of the present invention. In this embodiment, first a forming section 17 comprising a cylindrical forming portion 15 an d a tooth pattern portion 16 is formed in a die 14, then a cylindrical stock 18 is inserted into the cylindrical forming portion 15 in the forming section 17, a knock-out 19 inserted under rotation into the tooth pattern portion 16 of the molding section 17 is brought in to abutment against an end of the stock 18, and the opposite end of the stock 18 is pressed by means of a punch 20. As a result, the stock 18 flows within the forming section 17 and is formed as such a helical pinion gear 21 as shown in FIG. 3. In this case, the knock-out 19 is in abutment against the stock 18 with a predetermined pressing force, and a pressing force larger than the sum of the pressing force of the knock-out 19 and a pressing force for forming is applied to the punch 20. Consequently, the knock-out 19 moves down to a lower position than the initial position thereof to complete the forming work. In cold forging, the punch 20 and the knock-out 19 move axially while rotating, and the spacing between the two varies relatively. Therefore, until completion of the forming work, the punch 20 and the knock-out 19 are kept in abutment against upper and lower ends of the helical pinion gear 21. In this state, the punch 20 is allowed to escape upward and the knock-out 19 is raised while rotating, then the helical pinion gear 21 is taken out as a product.

The helical pinion gear 21 thus formed by cold forging is composed of a cylindrical portion 22 and a gear portion 23. In this case, a connection between the cylindrical portion 22 and the gear portion 23, i.e., a base part 24 of the gear portion 23, is formed accurately up to corner portions, and the gear portion 23 is also formed accurately without droop up to a tip end 25 thereof.

The helical pinion gear 21 thus formed is completed as a product by performing only such a slight degree of machining as finishing an end face of the tip end 25. Besides, the shape and size of the helical pinion gear are accurate throughout the whole thereof. Particularly, the. shape of the base part 24 of the gear portion 23 is accurate.

Although it is the helical pinion gear 21 that has been described as the product to be formed in the above embodiment, the present invention is also applicable to forming a stepped cylindrical member or a straight gear such as a spur gear. In this case, a more accurate forming than in the case of the helical pinion gear 21 can be effected.

Figure 4:
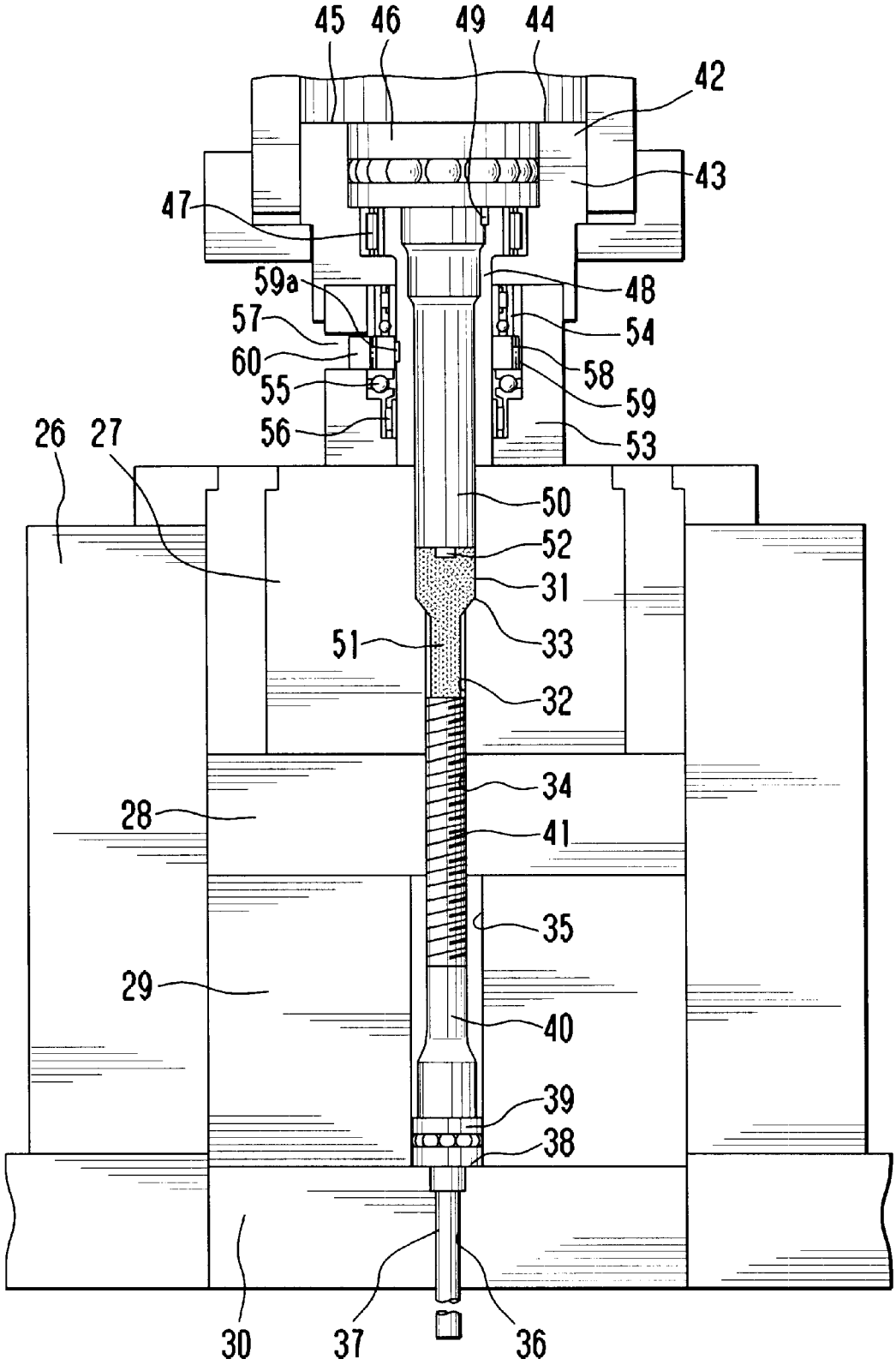
FIG. 4 is a side view in vertical section of a cold forging apparatus according to a second embodiment of the present invention.
Figures 5A, 5B, 5C, 5D, 5E, 5F:
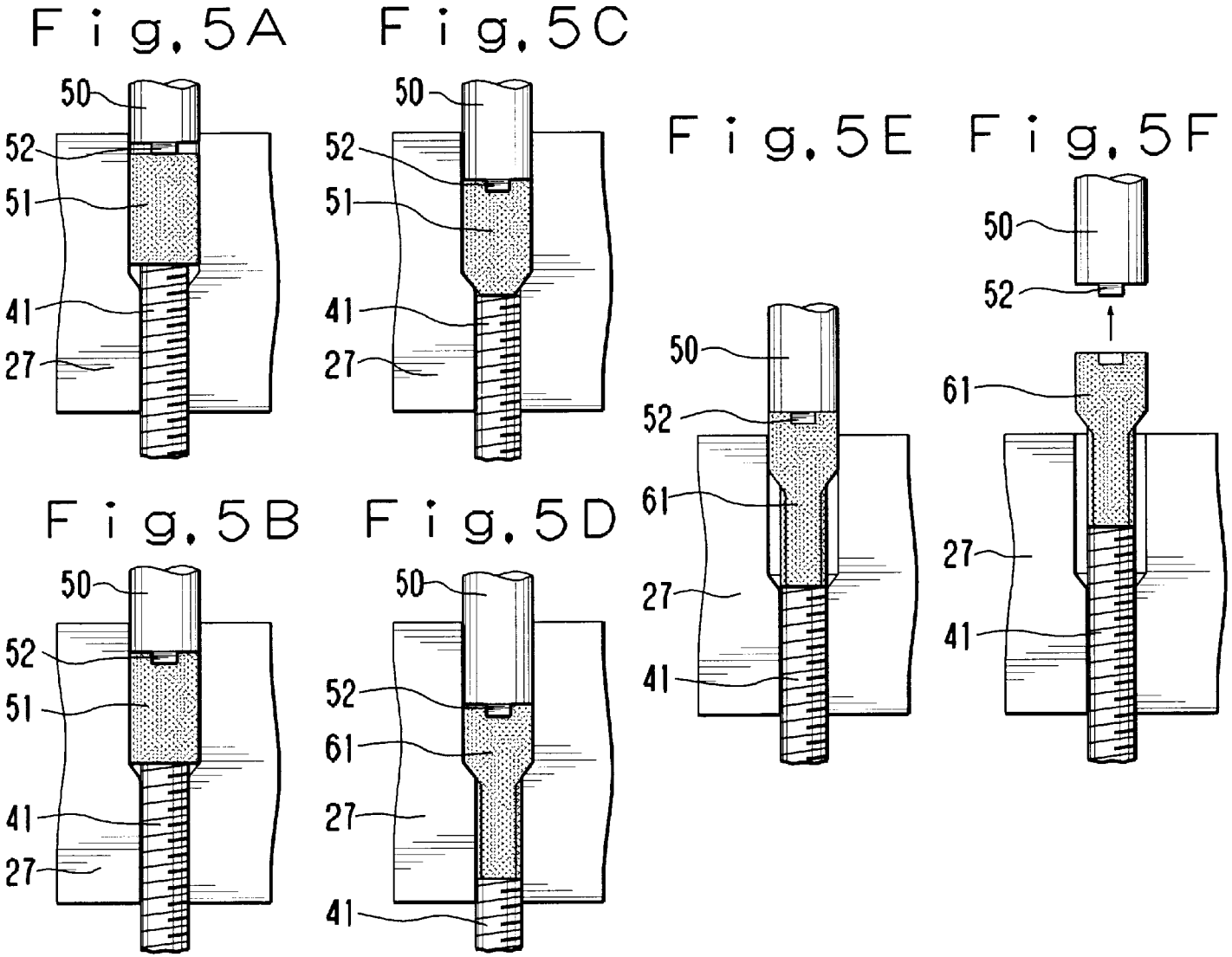
FIG. 5A is a side view in vertical section, showing a stock as inserted into a die.
FIG. 5B is a side view in vertical section, showing a state in which a predetermined pressing force has been applied to the stock by means of a punch and a knock-out.
FIG. 5C is a side view in vertical section, showing a state in which a forming work is being carried out while the punch and the knock-out are each moved down at a predetermined speed.
FIG. 5D is a side view in vertical section showing a state just after completion of the forming work.
FIG. 5E is a side view in vertical section showing a knocked-out state in a sandwiching relation to the resulting formed,product (a reverse rotation completed diagram)
FIG. 5F is a side view in vertical section, showing a state in which the formed product has been raised by the knock-out up to a position at which the product can be taken out.
Figure 6:
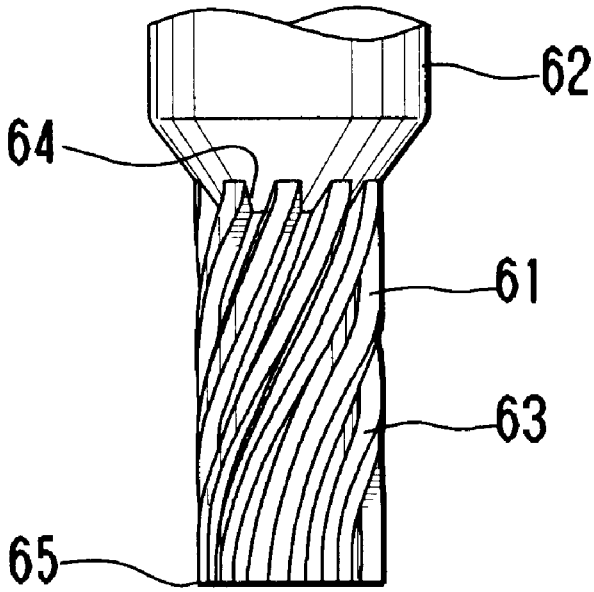
FIG. 6 is a side view in vertical section, showing a formed state
Figure 7:
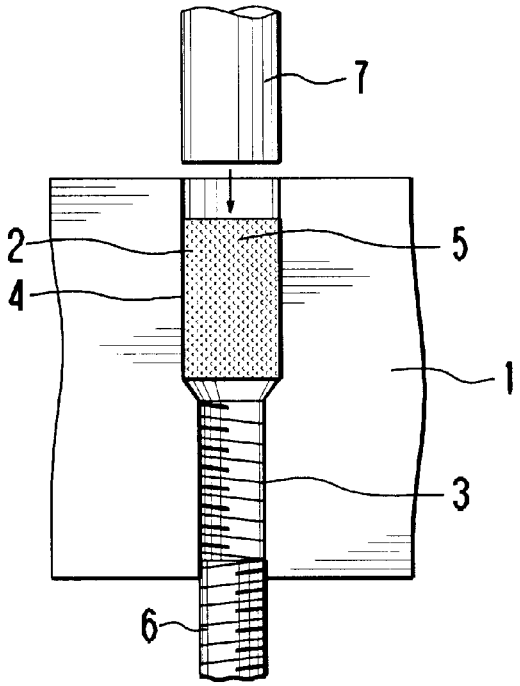
FIG. 7 is a side view in vertical section, showing a state before a forming work according to a conventional example.
Figure 8:
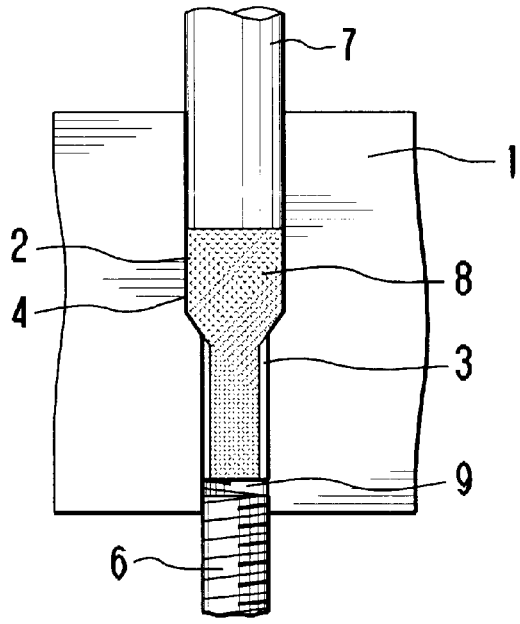
FIG. 8 is a side view in vertical section, showing a formed state in the conventional example.
Figure 9:
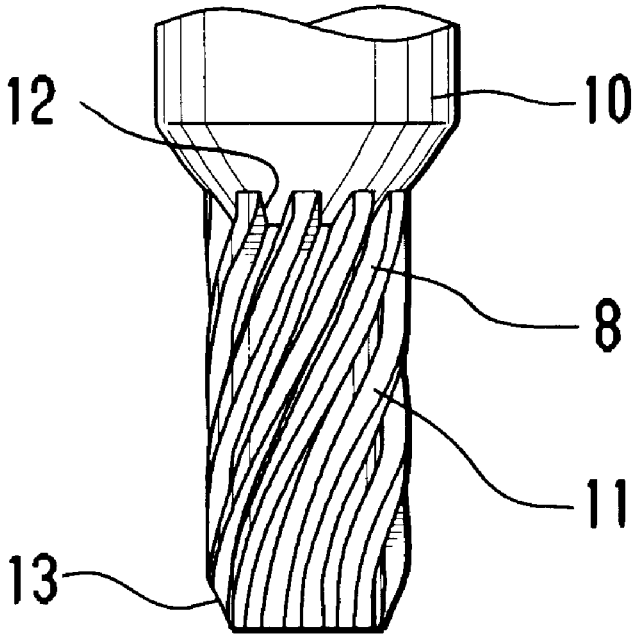
FIG. 9 is a front view of a helical pinion gear obtained by the forming work in the conventional example.

Referring now to FIGS. 4 to 6, there is illustrated a second embodiment of the present invention. As shown in those figures, in a lower base 26 are integrally stacked and assembled a die 27 and plates 28, 29, 30 successively from above. In the die 27 is formed a forming section 33 which comprises a cylindrical forming portion 31 and a tooth pattern portion 32. The tooth pattern portion 32 is formed in a helical shape at a predetermined helix angle. The plate 28 is formed with a tooth pattern 34 which is the same as the tooth pattern 32. In the plate 29 is formed a sliding bore 35 of a circular section which is larger in diameter than the tooth pattern 34. Further, in the plate 30 is formed a sliding guide bore 36 in alignment with the sliding bore 35, the sliding guide bore 36 being smaller in diameter than the sliding bore 35.

A knock-out pin 37 connected to a drive mechanism (not shown) is fitted in the sliding guide bore 36 slidably. On an upper surface of the plate 30 is formed a receiving stepped portion 38 because the diameter of the sliding guide bore 36 is smaller than that of the sliding bore 35, and a thrust bearing 39 is disposed so as to be received by the receiving stepped portion 38 and so as to be vertically slidable through the interior of the sliding bore 35. A knock-out 40 is coaxially provided on top of the thrust bearing 39 and an upper portion of the knock-out 40 is formed with a tooth pattern shaft 41 adapted to mesh with the tooth pattern 34, the tooth pattern shaft 41 being provided so as to move vertically while rotating. A tip end of the tooth pattern shaft 41 reaches the tooth pattern portion 32 of the die 27.

As an upper die, a punch unit 42 connected to a drive mechanism (not shown) is disposed so as to be slidable vertically. The punch unit 42 is provided with a case 43. An upper surface 44 of the case 43 is formed flat as a receiving portion 45, and a thrust bearing 46 is centrally mounted so as to be flush with the upper surface 44. In the case 43, a punch sleeve 48 is mounted rotatably through a thrust bearing 47 and in abutment against a lower surface of the thrust bearing 47. A punch 50 is mounted to the punch sleeve 48 while being swivel-stopped by a fixing pin 49. The punch 50 is fitted in the forming section 33 of the die 27 and a special shape portion 52 adapted to bite into a stock 51 to be subjected to forming is formed projectingly at a tip end of the punch 50. As the special shape portion 52 there may be adopted, for example, a spline portion, an elliptic portion, or a square or hexagonal projection.

A punch case 53 is fixed below the case 43, and a thrust-needle bearing 54, an angular bearing 55 and a needle bearing 56 are mounted in the punch case 53. Through the thrust-needle bearing 54 and the needle bearing 56 the punch sleeve 48 is held in the punch case 53 rotatably. Further, in an intermediate position of the punch case 53 is formed a cutout portion 57 which is open in one direction. A gear 59 as part of a rotational force imparting means 58 is mounted in the punch case 53 so as to be positioned within the cutout portion 57, the gear 59 being provided in a rotational direction fixed manner with use of a fixing pin 59a. Meshing with the gear 59 is a rack 60 which is reciprocated horizontally by means of a drive mechanism (not shown). The gear 59 and the rack 60 conjointly constitute the rotational force imparting means 58. For actuating the rack 60 there may used, for example, a hydraulic motor, a cylinder, or a cam.

In such a construction, the cylindrical stock 51 is inserted into the cylindrical forming portion 31 in the forming section 33, the knock-out 40 which has been inserted rotatively into the tooth pattern portion 32 in the forming section 33 is brought into abutment against an end of the stock 51 and the opposite end of the stock 51 is pressed down with the punch 50, as shown in FIG. 5A. In this state, the thrust bearing 39 is received by the receiving stepped portion 38 and a downward pressing force is exerted on the punch 50, whereby a predetermined pressing force is imposed on the stock 51, as shown in FIG. 5B. In this state, if a pressing force is further applied to the punch 50, the stock 51 flows within the forming section 33 and such a helical pinion gear 61 as shown in FIG. 6 is formed within the forming section 33 in the die 27. In this case, the knock-out 40 is abutted against the stock 51 with a predetermined pressing force, and a pressing force larger than the sum of the pressing force of the knock-out 40 and a pressing force for forming is applied to the punch 50. Consequently, the knock-out 40 moves to a position lower than its initial position to complete the forming work. Besides, in cold forging, the punch 50 and the knock-out 40 move axially while rotating and the spacing between. the two varies relatively. At this time, the special shape portion 52 formed at the tip end of the punch 50 bites into the stock 51, whereby the punch 50 and the stock 51 are rendered integral with each other in a rotational direction fixed manner, so that a rotational angle which has been imparted to the punch 50 through the rotational force imparting means 58 constituted by the rack 60 is transferred accurately to the stock 51, thus ensuring a highly accurate forming work. Therefore, until completion of the forming work, the punch 50 and the knock-out 40 are kept in abutment against upper and lower ends, respectively, of the helical pinion gear 61, as shown in FIG. 5D. In this state, the punch 50, the helical pinion gear 61, and the knock-out 40 move upward while rotating in the reverse direction and while keeping the sandwiching relation of the punch and the knock-out to the helical pinion gear. The reverse rotation is stopped upon arrival at the helical gear forming start point as in FIG. 5E, then the punch 50 further rises, permitting the product to be taken out from the die 27, as shown in FIG. 5F.

The helical pinion gear 61 thus formed by cold forging is made up of a cylindrical portion 62 and a gear portion 63. Even in the connection between the cylindrical portion 62 and the gear portion 63, that is, at a base part 64 of the gear portion 63, forming is effected accurately up to corner portions, and the gear portion 63 is formed accurately up to a tip end 65 thereof without causing droop. In the conventional cold forging method, a helix angle of the gear portion 63 encounters a limit at 30°, but according to this embodiment of the invention a forming work at a helix angle of above 30° is made feasible by rotating the punch 50.

Although this embodiment has referred to forming the helical pinion gear 61, the present invention is also applicable to forming a stepped cylindrical member or forming a straight gear such a spur gear. In this case, it is possible to effect a more accurate forming work than in the case of the helical pinion gear 61. Further, the use of a hydraulic motor permits forging of a worm screw and forming such a large gear as a transmission gear.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Document hei 12-55620 filed on Mar. 01, 2000 and 2000-287938 filed on Sep. 22, 2000 the content of which are rated herein by reference.

What is claimed is:

1. A cold forging method for forming a helical pinion gear having a cylindrical portion and a gear portion, comprising the steps of:

preparing a die having a forming section comprising a cylindrical forming portion and a tooth pattern portion;

inserting a stock into the cylindrical forming portion;

sandwiching the stock inserted into the die between a punch and a knock-out, the punch being rotatable with respect to the die and inserted from the cylindrical forming portion, the knock-out being engaged into the tooth pattern portion; and applying to the punch a pressing force so as to move the stock toward the tooth pattern portion without gap in the forming section while the pressing force applied to the punch rotates the punch, stock and knock-out.

2. A cold forging method according to claim 1, wherein the step of applying to the punch a pressing force comprises applying to the punch a rotating force.

3. A cold forging apparatus for forming a helical pinion gear having a cylindrical portion and a gear portion, comprising:

a die having a forming section having a cylindrical forming portion and a tooth pattern portion, the forming portion being configured to receive a stock;

a punch configured to be rotatably fitted into the cylindrical forming portion;

a knock-out configured to be screwed into the tooth pattern portion; and wherein when a pressing force is applied to the punch, the stock is moved toward the tooth pattern portion without gap in the forming section while the pressing force applied to the punch rotates the punch, stock and knock-out, thereby forming the stock into the helical pinion gear.

4. A cold forging apparatus according to claim 3, further comprising rotational force imparting means for imparting a rotational force to the punch.

5. A cold forging apparatus according to claim 4, wherein the rotational force imparting means comprises a punch sleeve mounted to a punch case rotatably, the punch being mounted to the punch sleeve in a rotational direction fixed manner, and a rack configured to be brought into mesh with a gear formed on the punch sleeve.

6. A cold forging apparatus according to claim 4, wherein the punch has a biting portion configured to bite into the stock at a tip end thereof.

7. A cold forging apparatus according to claim 3, wherein the knock-out is held by a thrust bearing.

* * * * *